US010482870B1

(12) United States Patent
Cheng

(10) Patent No.: US 10,482,870 B1
(45) Date of Patent: Nov. 19, 2019

(54) SOUND-PROCESSING APPARATUS AND SOUND-PROCESSING METHOD

(71) Applicant: Nanjing Horizon Robotics Technology Co., Ltd., Nanjing (CN)

(72) Inventor: Guangwei Cheng, Nanjing (CN)

(73) Assignee: NANJING HORIZON ROBOTICS TECHNOLOGY CO., LTD., Nanjing (CN)

( * ) Notice: Subject to any disclaimer, the term of this patent is extended or adjusted under 35 U.S.C. 154(b) by 0 days.

(21) Appl. No.: 16/398,007

(22) Filed: Apr. 29, 2019

(30) Foreign Application Priority Data

Apr. 10, 2018 (CN) ..... 2018 1 0315516

(51) Int. Cl.
*G10K 11/178* (2006.01)

(52) U.S. Cl.
CPC ..... *G10K 11/17823* (2018.01); *G10K 2210/3044* (2013.01)

(58) Field of Classification Search
CPC ..... G10K 11/17827; G10K 11/17823; G10K 11/17817; G10K 11/17857; G10K 11/17873; G10K 11/17881; G10K 11/17885; G10K 2210/505; G10L 21/0208; G10L 21/02082
See application file for complete search history.

(56) References Cited

U.S. PATENT DOCUMENTS

2017/0040015 A1* 2/2017 Torres ..... G10K 11/178

* cited by examiner

*Primary Examiner* — Kile O Blair
(74) *Attorney, Agent, or Firm* — Loeb & Loeb LLP

(57) ABSTRACT

A sound-processing apparatus comprises at least one pair of sound transducers. A first sound transducer may receive an audio source signal and output a first sound signal according to the audio source signal. A second sound transducer may receive the audio source signal and output a second sound signal according to the audio source signal, the second sound signal having opposite phase from the first sound signal. A difference between the second and first sound signal amplitudes may be less than or equal to an amplitude threshold value. A sound acquisition device may acquire a sound signal. Path-characteristic differences between amplitude-frequency characteristics of a first sound path from the first sound transducer to the sound acquisition device and a second sound path from the second sound transducer to the sound acquisition device may be less than or equal to a first characteristic threshold value.

15 Claims, 3 Drawing Sheets

SOUND-PROCESSING APPARATUS AND SOUND-PROCESSING METHOD

FIELD OF THE INVENTION

The present disclosure relates to the field of audio technology, and in particularly, relates to a sound-processing apparatus and a sound-processing method.

BACKGROUND

With the development in technology, deep learning technologies are applied on voice to enable voice recognition and voice print recognition etc. to achieve better effects. Man-machine interaction, as a more natural interaction way, is also raised a higher requirement, especially an awakening scene, where requires the machine to "understand" an instruction sent by the user when the machine is speaking. However, the voice recognition and voice print recognition techniques, while achieving significant advances in recognition effects, raise a stringent requirement on a signal-noise ratio of the signal, requiring the maximum cancellation of the sound emitted by the machine itself to improve the signal-noise ratio.

SUMMARY OF THE INVENTION

In order to solve the above technical problems, embodiments of the present disclosure provide a sound-processing apparatus and a sound-processing method, which can achieve a good effect on physical noise reduction.

According to one aspect of the present disclosure, a sound-processing apparatus is provided, the sound-processing apparatus comprising:

at least one pair of sound transducers, each pair of sound transducers comprising:

a. a first sound transducer for receiving an audio source signal and outputting a first sound signal according to the audio source signal; and b. a second sound transducer for receiving the audio source signal and outputting a second sound signal according to the audio source signal, the second sound signal having an opposite phase from the first sound signal, and difference between an amplitude of the second sound signal and an amplitude of the first sound signal being less than or equal to an amplitude threshold value; and a sound acquisition device for acquiring a sound signal, wherein path-characteristic difference between an amplitude-frequency characteristic of a first sound path from the first sound transducer to the sound acquisition device and an amplitude-frequency characteristic of a second sound path from the second sound transducer to the sound acquisition device being less than or equal to a first characteristic threshold value.

According to another aspect of the present disclosure, a sound-processing apparatus is provided, the sound-processing apparatus comprising:

at least one set of sound transducers, each set of sound transducers comprising:

a. a first sound transducer for receiving a left channel signal of stereo source signals and outputting a first sound signal according to the left channel signal;

b. a second sound transducer for a receiving right channel signal of the stereo source signals and outputting a second sound signal according to the right channel signal;

c. a third sound transducer for receiving the left channel signal and outputting a third sound signal according to the left channel signal; and d. a fourth sound transducer for receiving the right channel signal and outputting a fourth sound signal according to the right channel signal, the third sound signal having an opposite phase from the first sound signal, and difference between an amplitude of the third sound signal and the first sound signal are less than or equal to a first amplitude threshold value, and the fourth sound signal having an opposite phase from the second sound signal and difference between an amplitude of the fourth sound signal and the second sound signal are less than or equal to a second amplitude threshold value; and a sound acquisition device for acquiring a sound signal, first path-characteristic difference between an amplitude-frequency characteristic of a first sound path from the first sound transducer to the sound acquisition device and an amplitude-frequency characteristic of a third sound path from the third sound transducer to the sound acquisition device being less than or equal to a first characteristic threshold value; and second path-characteristic difference between an amplitude-frequency characteristic of a second sound path from the second sound transducer to the sound acquisition device and an amplitude-frequency characteristic of a fourth sound path from the fourth sound transducer to the sound acquisition device being less than or equal to a second characteristic threshold value.

According to another aspect of the present disclosure, a sound-processing method is provided, the sound-processing method comprising:

receiving an audio source signal by a sound-processing apparatus, the sound-processing apparatus including at least a pair of sound transducers and a sound acquisition device, each pair of sound transducers including a first sound transducer and a second sound transducer;

outputting, by the first sound transducer, a first sound signal according to the audio source signal; and outputting, by the second sound transducer, a second sound signal according to the audio source signal, the second sound signal having an opposite phase from the first sound signal, and difference between an amplitude of the second sound signal and an amplitude of the first sound signal being less than or equal to an amplitude threshold value.

Compared with the prior art, by adopting the sound-processing apparatus and the sound-processing method according to embodiments of the present disclosure, the original sound signals acquired by the sound acquisition device obtain a higher signal-noise ratio than the sound signals acquired when being output by a single sound transducer, and a good effect on physical noise reduction is achieved.

BRIEF DESCRIPTION OF THE DRAWINGS

The above mentioned and other objections, features, and advantages will be more obvious by the detail description to embodiments of the present disclosure combining accompanying drawings. The drawings are provided to further understand the embodiments of the present disclosure and form a part of the present disclosure to interpret the present disclosure with the embodiments of the present disclosure. However, the drawings are not to limit the present disclosure. The same reference signs generally represent the same parts or steps in the drawings.

DETAILED DESCRIPTION

Hereinafter, exemplary embodiments of the present disclosure will be described in detail with reference to the accompanying drawings. It is apparent that the described embodiments are only part of embodiments, not all embodiments of the present disclosure. It should be understood that the present disclosure is not limited by the exemplary embodiments described herein.

Overview

As mentioned above, an echo is required to be cancelled out in an event of man-machine interaction and communication and so on. Currently, an echo is cancelled out primarily through a software algorithm (e.g, an adaptive filtering algorithm).

However, there are following disadvantages to echo cancellation implemented by the software algorithm:

1. noise reduction effect directly relates to convergent result of a filter and the dependence is too strong, if an echo is eliminated completely by an adaptive filtering algorithm;
2. when the signal-noise ratio is below 0 dB, it is difficult to determine or prone to mistakenly determine for a double-talk (DT), and mistake determination to the DT causes the adaptive filter to not converge instead to diverge. Here, the double-talk refers to a person and a speaker on the machine speaking at the same time, and more broadly speaking, while the speaker is playing, a local audio source also makes a sound, including but not limited to, human voice;
3. the noise reduction effects is remarkably degraded when a transfer function is suddenly changed (eg, the volume is adjusted);
4. the filter of algorithm can not converge and even diverge in a long time, and the filtering effect at the moment is degraded, when background ambient noise energy of the usage scene is relatively high;
5. an effect of poor echo cancellation in a low-frequency region is caused for the general speaker has a weak low-frequency radiation signal, while the practical environment has high energy of low-frequency noise.

For the technical problem, the basic concept of the present disclosure is to provide a sound-processing apparatus and a sound-processing method which can achieve a higher signal noise ratio for an opposite phase symmetrical characteristic with equal amplitude of sound signals output by at least a pair of sound transducers than that in a acquisition situation of sound signals output by a single sound transducer, thereby achieving a good effect on physical noise reduction.

It should be noted that the above basic concept of the present disclosure may be not only applied to cancel out an echo in a scenario such as man-machine interaction and communication and so on, and may also be applied to other scenarios where requires to cancel out the echo.

After introducing of the basic concept of the present disclosure, various non-limiting embodiments of the present disclosure will be described in detail below with reference to the accompanying drawings.

Exemplary Apparatus

Figure 1:
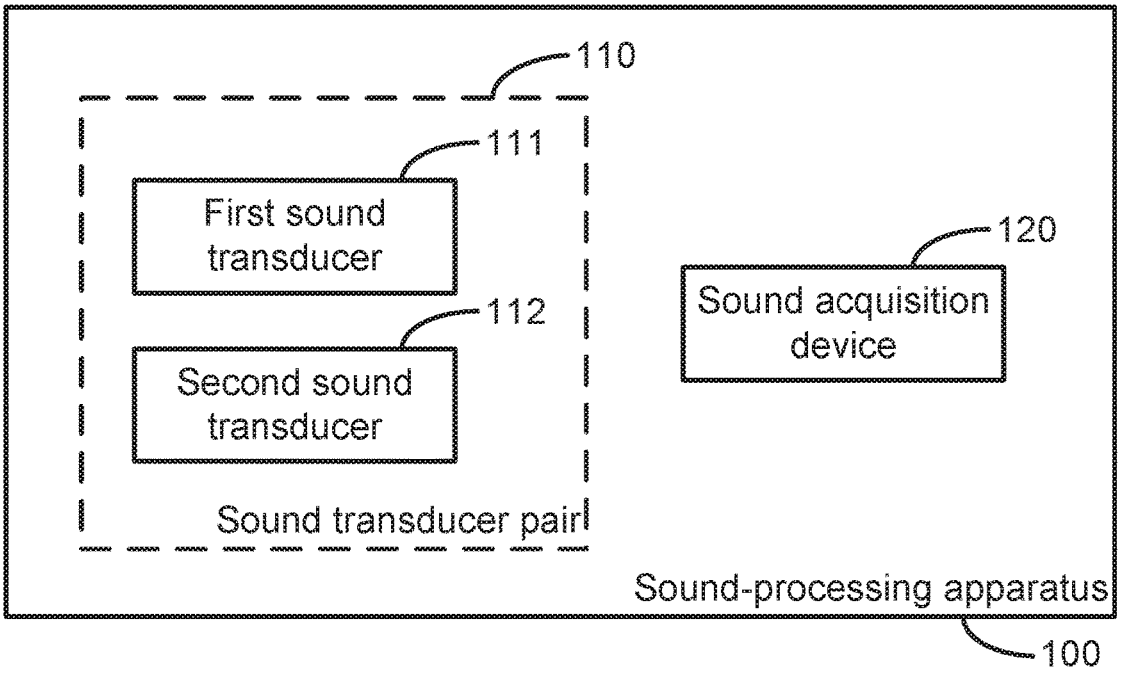
FIG. 1 illustrates a block diagram of a sound-processing apparatus according to an embodiment of the present disclosure.

FIG. 1 illustrates a block diagram of a sound-processing apparatus according to an embodiment of the present disclosure.

As shown in FIG. 1, a sound-processing apparatus 100 according to an embodiment of the present disclosure comprises at least one pair of sound transducers 110, each pair of sound transducers 110 comprises a first sound transducer 111 for receiving an audio source signal and outputting a first sound signal according to the audio source signal; and a second sound transducer 112 for receiving the audio source signal and outputting a second sound signal according to the audio source signal.

In one example, the second sound signal has an opposite phase from the first sound signal, and difference between an amplitude of the second sound signal and an amplitude of the first sound signal is less than or equal to an amplitude threshold value, preferably zero.

That is, the first sound signal and the second sound signal output by the first sound transducer 111 and the second sound transducer 112 respectively have the same amplitude and the opposite phases, ie, symmetric characteristic of the same amplitude and the opposite phases.

The sound-processing apparatus 100 according to the embodiment of the present disclosure also comprises a sound acquisition device 120 for acquiring a sound signal. For example, the sound acquisition device 120 may be a microphone MIC which is a transducer device that converts a sound signal into an electrical signal.

In one example, path-characteristic difference between an amplitude-frequency characteristic of a first sound path from the first sound transducer 111 to the sound acquisition device 120 and an amplitude-frequency characteristic of a second sound path from the second sound transducer 112 to the sound acquisition device 120 may be less than or equal to a first characteristic threshold value, preferably zero.

Thus, in the sound-processing apparatus according to an embodiment of the present disclosure, a pair of sound transducers 111 and 112 are utilized to enable the first sound signal and the second sound signal output by the two sound transducers 111 and 112 have opposite phases and equal (approximately equal) amplitude. Moreover, since there is equal (approximately equal) amplitude-frequency characteristic between the first sound path from the first sound transducer 111 to the sound acquisition device 120 and the second sound path from the second sound transducer 112 to the sound acquisition device 120, an aquired first component corresponding to the first sound signal and an aquired second component corresponding to the second sound signal have substantially opposite phases and equal amplitude when the sound acquisition device 120 acquires the sound signals, which indicates that sampled point values of the first component corresponding to the first sound signal add sampled point values, sampled at the same time, of the second component corresponding to the second sound signal to obtain a sum zero, thereby achieving physical superposition cancellation of both in the acquired final signal.

Figure 2:
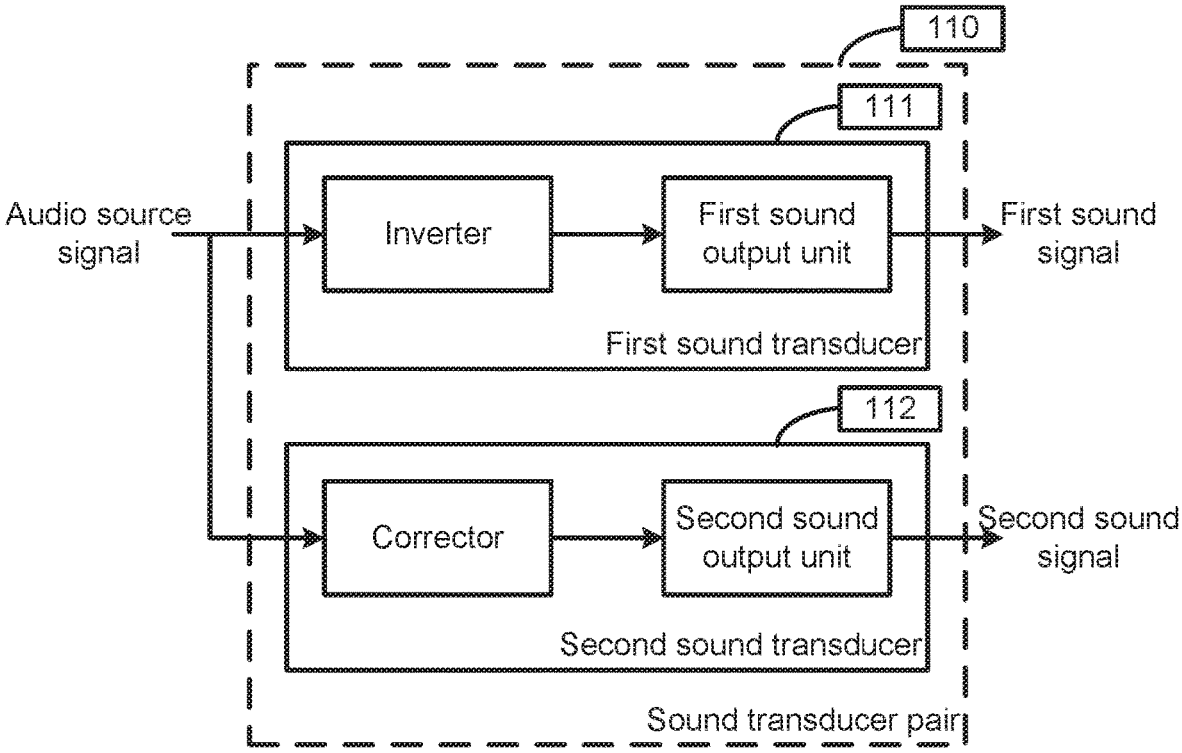
FIG. 2 illustrates an example of detailed structure of pair of sound transducer according to an embodiment of the present disclosure.

FIG. 2 illustrates a specific structural example of a pair of sound transducers according to an embodiment of the present disclosure.

As shown in FIG. 2, in order to achieve the sound conversion function, each of the pair of sound transducers 110, ie, the first sound transducer 111 and the second sound transducer 112, may include a sound output unit SPK for converting the audio source signal into a sound signal. For example, the sound output unit may be a speaker which is a transducer device converting an electrical signal into a sound signal. The types of speaker are numerous, and can be classified into an electrodynamic speaker (ie, a moving coil speaker), an electrostatic speaker (ie, a capacitive speaker), an electromagnetic speaker (ie, a reed speaker), a piezoelectric speaker (ie, a crystal speaker), etc, according to the transduction principle thereof.

To enable the first sound signal output by the first sound transducer 111 and the second sound signal output by the second sound transducer 112 to have an opposite phase characteristic, one of the first sound transducer 111 and the second sound transducer 112 may further include an inverter INV for inverting the audio source signal and providing the inverted audio source signal to a first sound output unit SPK1 of the first sound transducer 111 or a second sound output unit SPK2 of the second sound transducer 112. That is, the inverter INV is used to receive the audio source signal, and to connect with the first sound conversion unit SPK1 or the second sound conversion unit SPK2 to provide the inverted audio source signal.

For example, the first sound transducer 111 includes the first sound output unit SPK1 for converting the audio source signal into the first sound signal. The second sound transducer 112 includes an inverter INV for inverting the audio source signal; and a second sound output unit SPK2 for converting the inverted audio source signal into the second sound signal.

In order to enable the first sound signal output by the first sound transducer 111 and the second sound signal output by the second sound transducer 112 to have an equal (approximately equal) amplitude-frequency characteristic, unit-characteristic difference between an amplitude-frequency characteristic of the first sound output unit SPK1 and an amplitude-frequency characteristic of the second sound output unit SPK2 is less than or equal to a second characteristic threshold value, preferably zero.

That is, for the first sound output unit SPK1 and the second sound output unit SPK2, it is ensured that the amplitude-frequency characteristic of the first sound output unit SPK1 and that of the second sound output unit SPK2 have good consistency. Here, the amplitude-frequency characteristic refers to a relationship between the steady state output of the amplitude at a given frequency and the input. This relationship specifically refers to a function relationship between the ratio of the output amplitude to the input amplitude and the input frequency.

Thus, by means of the above mentioned structure, the original audio source signal is a monophonic signal transmitted to two sound output units SPK in two paths, for example, through one of which the original audio source signal is transmitted to the inverter INV before being sent to the first sound output unit SPK1, and through the other of which the original audio source signal is directly transmitted to the second sound output unit SPK2 without passing through the inverter INV. The inverter inverts every sample point, i.e. multiplied by −1, achieving the function of phase inversion.

In addition, on one hand, there may be more or less unit-characteristic difference between the amplitude-frequency characteristic of the first sound output unit SPK1 and the amplitude-frequency characteristic of the second sound output unit SPK2, which may result in certain characteristic difference (amplitude difference) between the first sound signal output by the first sound output unit and the second sound signal output by the second sound output unit. On the other hand, there may be more or less path-characteristic difference between the amplitude-frequency characteristic of the first sound path PATH 1 from the first sound transducer 111 to the sound acquisition device 120 and that of the second sound path PATH 2 from the second sound transducer 112 to the sound acquisition device 120, which may cause the first sound signal and the second sound signal to transmit to the sound acquisition device 120 and may result in certain characteristic difference (amplitude difference) between the two signal components acquired by the sound acquisition device 120.

To eliminate amplitude difference between the first component corresponding to the first sound signal and the second component corresponding to the second sound signal acquired by the sound acquisition device 120 due to the unit-characteristic difference and/or path-characteristic difference, one or both of the first sound transducer 111 and the second sound transducer 112 may further include a corrector COR for compensating for one of the path-characteristic difference and the unit-characteristic difference, to elimintate signal component characteristic (amplitude difference) due to the sound output unit SPKs and the sound path PATHs.

That is, the corrector COR is used to compensate for at least one of the audio source signal and the inverted audio source signal according to the characteristic difference before providing one of the audio source signal and the inverted audio source signal to one of the first sound output unit SPK1 and the second sound output unit SPK2, and the other one of the audio source signal and the inverted audio source signal to the other one of the first sound output unit SPK1 and the second sound output unit SPK2. Here, those skilled in the art should appreciate that the corrector COR may also be connected to either or both of the first sound output unit and the second sound output unit.

Therefore, the corrector COR may be used to compensate for amplitude difference between the second sound signal and the first sound signal such that the amplitude of the first sound signal and the amplitude of the second sound signal received by the sound acquisition unit 120 are equal.

For example, the first sound transducer 111 may further include a corrector COR for compensating the audio source signal according to at least one of the path-characteristic difference and the unit-characteristic difference before the audio source signal reaches the first sound output unit SPK1.

Additionally or alternatively, the second sound transducer 112 may further include a corrector COR for compensating the audio source signal or the inverted audio source signal according to the path-characteristic difference and/or the unit-characteristic difference (preferably, both) before the audio source signal reaches the inverter INV or before the inverted audio source signal reaches the second sound output unit SPK2.

In this way, the corrector COR can compensate for a power amplification difference between the two sound output units SPK1 and SPK2 and/or the attenuation difference between the two sound paths PATH1 and PATH2.

Specifically, although it is desirable that in the ideal case, the first sound output unit SPK1 and the second sound output unit SPK2 have the identical amplitude-frequency characteristic, in practice, the two sound output units screened out generally have difference in playing power amplification. For example, for the difference inherent to the two sound output units, the transfer functions w1 and w2 corresponding to transduction of the two sound output units can be measured in advance. In the case of the corrector COR being connected to the second sound output unit SPK2, the signal sent to the second sound output unit SPK2 is convolved by the corrector COR by w1/w2. In the case of the corrector COR being connected to the first sound output unit SPK1, the signal transmitted to the first sound output unit SPK1 is convolved by the corrector COR by w2/w1. In this way, it can be ensured that the output signals after transducing the two sound output signals are as consistent as possible.

In an embodiment of the present disclosure, the characteristic difference between the amplitude-frequency characteristic of the first sound path PATH1 from the first sound transducer 111 to the sound acquisition device 120 (ie, from the output of the first sound output unit SPK 1 to the input of the sound acquisition device 120) and the amplitude-frequency characteristic of the second sound pah PATH2 from the second sound transducer 112 to the sound acquisition device 120 (i.e. from the output of the second sound output unit SPK2 to the input of the sound acquisition device 120) is less than or equal to the first threshold value, ie, the length of the first sound path PATH 1 may be set equal to the length of the second sound path PATH 2.

In one example, the first sound output unit SPK1 and the second sound output unit SPK2 may be plane-symmetrically arranged with respect to the sound acquisition device 120.

To this end, the sound-processing apparatus 100 according to an embodiment of the present disclosure may further comprise a shell SHEL having a first position, a second position and a third position that are symmetrical with respect to the first position, the sound acquisition device 120 being arranged at the first position, the first sound output unit SPK1 and the second sound output unit SPK2 being arranged at the second position and the third position, respectively, and having the same distance and orientation angle relative to the sound acquisition device 120.

The placement position of the two sound output units SPK on the shell (mold) SHEL may be symmetrical and the shell SHEL has one or more symmetrical faces, while the composite structure constituted by the sound output unit SPK and the shell SHEL is symmetrical too.

The symmetry of the shell ensures that the transmission paths of the sound are symmetrical and the transmission distances are equal when the sound output by the two sound output units SPK reach any one of positions on the spatially symmetrical faces of the two sound output units SPK (ie, the vertical bisector of connection line of the output points in the two sound output units SPK), thereby ensuring that the two sound signals experience equal transmission losses.

In addition, in order to further ensure that the transmission paths have the same amplitude-frequency characteristic, material of the shell SHEL can be made to be symmetrical consistency with respect to the sound acquisition device 120. The symmetrical consistency includes material density, thickness, etc in the symmetrical locations being as uniform as possible to ensure that the acoustic response of the symmetrical positions is as consistent as possible. More simply, the material of the entire shell may be made uniform.

The sound acquisition device 120 is required to be placed on the symmetrical surface of a composite structure which is constituted by the shell and the sound output unit, to ensure that the signal energy attenuation and phase offset of the signal output by the two sound output units SPK reaching the sound acquisition device 120 are consistent. It is ensured that phase difference of every frequency band of signals, received by the sound acquisition device 120, output by the two sound output units SPK is constant to achieve an effect of simultaneous cancellation of each frequency band, only when the distance difference between the two sound output units SPK to the sound acquisition device 120 respectively is equal.

In the following, an example of detailed structure of a sound-processing apparatus according to an embodiment of the present disclosure now is explained with reference to FIG. 3.

Figure 3:
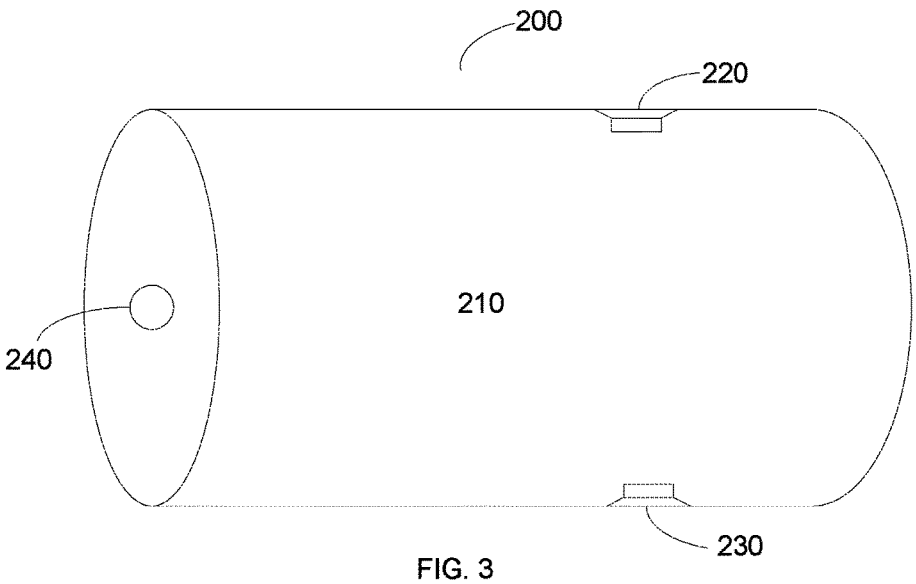
FIG. 3 illustrates an example of detailed structure of a sound-processing apparatus according to the present disclosure.

FIG. 3 illustrates an example of detailed structure of a sound-processing apparatus of an embodiment of the present disclosure.

As shown in FIG. 3, a sound-processing apparatus 200 according to an embodiment of the present disclosure comprises a cylindrical shell 210, a first speaker 220, a second speaker 230, and a microphone 240. The first speaker 220 and the second speaker 230 are used as a first sound output unit and a second sound output unit, and the microphone 240 is used as a sound acquisition device.

It is ensured that the frequency response characteristics (eg, amplitude and phase characteristics) of the first speaker 220 and the second speaker 230 are good consistent. The placement positions of the two speakers on the shell (mold) are also symmetrical. The shell has one or more symmetrical faces too, and the composite structure of the speaker and the shell is also symmetrical with respect to the microphone 240.

As shown in FIG. 3, a symmetrical cylinder mold is designed, two speakers are placed on the mold in a symmetrical manner, and the microphone is placed on the vertical bisection of the two speakers.

That is, the shell 210 is a cylinder, the microphone 240 is disposed at a central location on the bottom surface of the cylinder, and the first speaker 220 and the second speaker 230 are disposed at positions on the circumferential surface of the cylinder symmetrical with respect to the axis of the cylinder.

With such a structure, the audio signal to be played can be converted into two-channel signals, and the two-channel signals are opposite in phase. Due to the symmetrical relationship, the delay and energy attenuation of the signals played by the two speakers reaching the microphone are consistent, and finally cancel out each other at the intermediate point because the two signals have a 180° phase difference, i.e. opposite in phase, where the amplitudes of the speakers superposed are close to zero, ie, signals from the speakers acquired by the microphone are minimized.

Of course, those skilled in the art should appreciate that the shell 210 is shown as a cylinder in FIG. 3, and the first speaker 220 and the second speaker 230 are located in a plane of the shell symmetrical along the central axis of the cylinder, however, the shell 210 may be other shapes, and the first speaker 220 and the second speaker 230 may also be located at other locations of the shell as long as the shell has one or more symmetrical planes with respect to the sound acquisition device, and the first sound output unit 220 and the second sound output unit 230 are disposed in the symmetrical planes and have the same distance and orientation angle with respect to the sound acquisition device 240.

For example, the shell may also be a cuboid, and the first sound output unit 220 and the second sound output unit 230 may be disposed at symmetrical positions (eg, symmetrical positions on two opposing sides with respect to a volume centerline of the cuboid) of the cuboid, the sound acquisition device 240 may be disposed at a central position on a bottom surface of the cuboid.

In addition, the shell can also be a regular hexagonal prism, and the first sound output unit 220 and the second sound output unit 230 can be arranged at symmetrical positions on two opposite sides of the shell, and the sound acquisition device can be arranged at the center position of one bottom surface of the shell. Alternatively, the first sound output unit 220 and the second sound output unit 230 may also be disposed at symmetrical positions of two adjacent sides of the shell with respect to their common side, and the sound acquisition device is disposed on a bottom surface of the shell at any positions on a connecting line (and its extending line) between the common line and the central position.

In addition, in a sound-processing apparatus according to an embodiment of the present disclosure, more than one pairs of sound transducers may be included as long as they meet the requirement of the output sound signals having the same amplitude and opposite phase symmetrical characteristics with respect to the sound acquisition device.

For example, continuing with this cylindrical shell example, where the sound-processing apparatus comprises two pairs of sound transducers, ie where the sound-processing apparatus comprises four sound output units, the four sound output units may be disposed at four locations on a ring, parallel with the bottom surface, of the circumferential surface of the shell, 0 degree, 90 degree, 180 degree, and 270 degree, and the sound acquisition device may still be disposed at a central position on the bottom surface of the shell.

Alternatively, where the shell is a regular tetrahedron, the four sound output units may be disposed at the four vertex positions of the regular tetrahedron, respectively, while the sound acquisition device may be disposed at the center of the body. Here, the position where the sound acquisition device is located is the only one having equal distances to the four sound output units. Therefore, the four sound output units can be divided into two sets, one of which plays the same signal, and the other of which plays a signal opposite in phase. According to the arrangement, the signal energy played at other positions can be improved while the signal-noise ratio acquired by the sound acquisition device is ensured to be as low as possible.

That is, in a sound-processing apparatus according to an embodiment of the present disclosure, the shell is a regular tetrahedron, the at least one pair of sound transducers comprise two pairs of sound transducers, two first sound output units and two second sound output units are respectively arranged at four vertex positions of the shell, and the sound acquisition device is arranged at the center position of the regular tetrahedron.

Accordingly, each of the sound output units SPK may be arranged in other manners with respect to the sound acquisition device 120 except plane symmetry, so long as it is ensured that the amplitude-frequency characteristics of each sound path are equal or approximately equal.

Further, in the case of the four (or multiples of 4) sound output units described above, in addition to dividing the four sound output units into two sets, one set playing the same monophonic signal, and the other set playing the same monophonic signal with an opposite phase, the four sound output units may also be divided into two sets, one set playing sound signals in one stereo channel (ie, a speaker of the set plays a left channel signal in one stereo channel, and another speaker of the set plays a right channel signal in one stereo channel), while the other set of speakers playing the stereo signal with an opposite phase (i.e. one speaker of the set plays an inverted signal in the left channel, and another speaker plays an inverted signal in the right channel). In this way, in the case of a stereo signal rather than a monophonic signal, the physical superpose cancellation of echoes is achieved, thereby achieving a stereo scene of automatic echo cancellation (AEC). Since the stereo echo cancellation is traditionally more computationally intensive than that of a single audio source, while there is a special requirement for two channel signals, ie. the correlation can not be too high, the application here can attenuate the correlation of the two channels, helping to cancel the stereo echo cancellation.

Additionally, in addition to a direct path of sound signal from the sound output unit to the sound acquisition device, there may be sound signal communicated in other ways, such as a reflected sound signal transmitted back under the room environment, in view of the sound signal propagation characteristic. Since the path of the reflected sound signal is much longer than the direct path of the sound signal, the sound signal acquired by the sound acquisition device also refers the energy of the direct sound signal to be the principal energy, the weaker reflected sound signal is negligible, or further eliminated by echo cancellation.

In order to better remove an echo signal, a sound-processing apparatus according to an embodiment of the present disclosure may further comprises a sampler for sampling the audio source signal to obtain a reference signal; and an echo canceller for performing noise reduction processing on a sound signal acquired by the sound acquisition device based on the reference signal.

Here, the echo canceller may cancel out a residual component of the audio source signal from the sound signal acquired by the sound acquisition device based on the reference signal by at least one of an adaptive filtering algorithm and a double-talk (DT) control mechanism.

Specifically, in the case of an adaptive filtering algorithm, coefficient of an adaptive filter may be updated according to the following formula:

$$W(n+1)=W(n)+\mu e(n)X(n)/E\{|X(n)|^2\}$$

Where W(n) is an coefficient of an adaptive filter for the last iteration output, W(n+1) is an updated coefficient of the adaptive filter, w(0) is a 0 vector; p is a constant, e(n) is a residual signal, and X(n) is an original noise source signal (i.e., the reference signal). Wherein W, X are both vectors and E represents an averaging operation.

In addition, the residual signal e(n) is represented by the following formula:

$$e(n)=d(n)-X^T(n)W(n)$$

Where d (n) is an original signal from a signal source (i.e., the sound signal acquired by the sound acquisition device).

Figure 4:
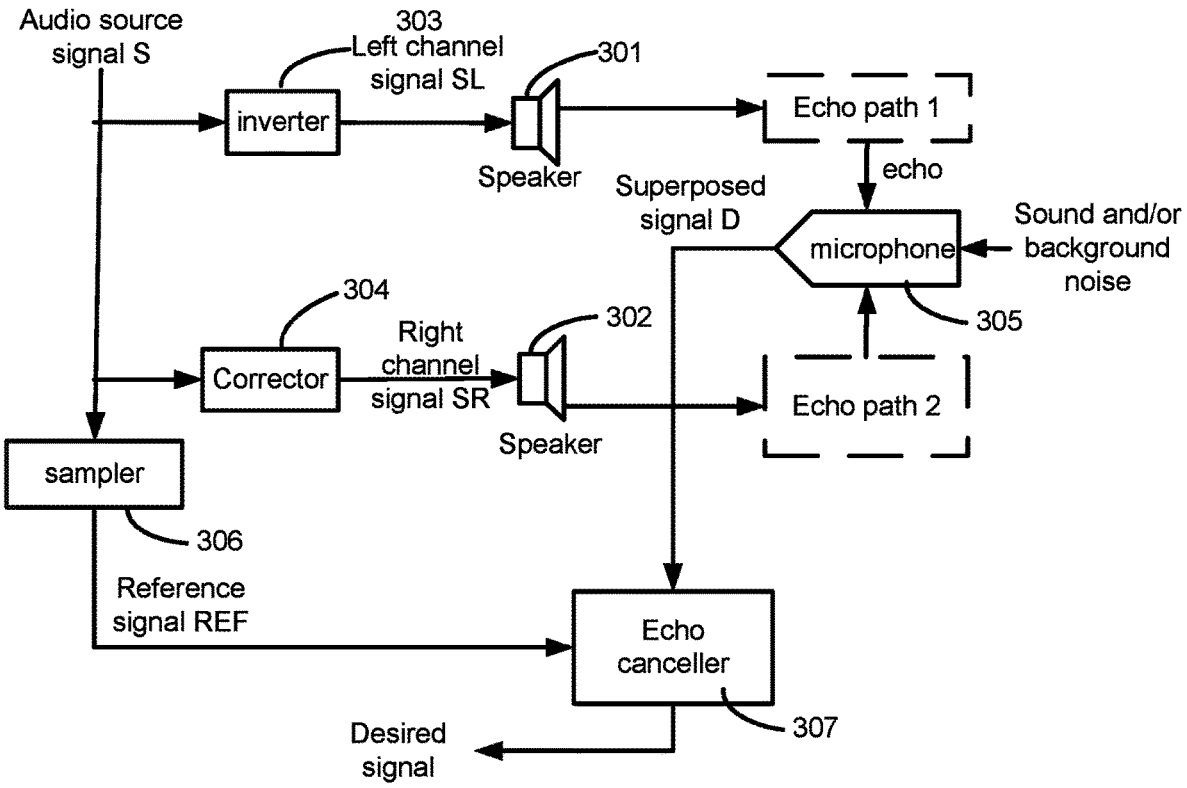
FIG. 4 illustrates a detailed application example of a sound-processing apparatus according to an embodiment of the present disclosure.

FIG. 4 illustrates a specific application example of a sound-processing device according to an embodiment of the present disclosure.

As shown in FIG. 4, the audio source signal to be played is S divided into two paths as a dual-channel audio file, a left channel signal SL and a right channel signal SR, and the left channel signal SL is obtained after the inverter 303, and the right channel signal SR is obtained after a corrector 304, SL=−SR (or SL≈−SR). The SL signal is played through a speaker 301, and the SR signal is simultaneously played through a speaker 302, and a microphone 305 for recording is placed on a vertical bisecting plane with respect to the speaker 301 and the speaker 302. The microphone acquires a superposed signal D of signals from the two speakers and a signal of the near-end local sound and/or background noise, where the superposed signal D has been physically echoes cancelled. The superposed signal D and the reference signal REF acquired by a sampler 306 are then sent to the echo canceller 307 simultaneously for further echo cancellation.

Here, the audio source signal S is sound to be played through a machine speaker, the inverter 303 is configured to delay the phase of the audio source signal S 180°, and the corrector 304 includes a set of filter coefficients for correcting difference between the speaker 301 and the speaker 302 so that the sound output by the two speakers is as uniform as possible.

The speaker 301 and the speaker 302 are playback hardware units for playing a sound signal. Echo path 1 is an echo path from the speaker 301 to the microphone 305; echo path 2 is an echo path from the speaker 302 to the microphone 305. The microphone 305 is an acquisition unit for acquiring a sound signal.

The sampler 306 is used to acquire a played audio signal.

The echo canceller 307 is an overall echo cancellation system implemented by a software algorithm and a double-talk control mechanism, and its input is the reference signal REF and the superposed signal D acquired by the microphone, further it reduces noise using the adaptive filtering algorithm. Here, the double-talk control mechanism considers to be a double-talk if a ratio of the signal energy received by the current microphone and the reference signal energy acquired by the sampler, that is, if the sound received by the microphone is more than the sound output by the speaker, a double-talk is considered to be constituted.

That is, the audio source signal to be played is firstly divided into two paths, along one path a signal being directly transmitted to a speaker 1 through a reverser, and along the other path a signal being sent to a speaker 2 through a corrector to reduce the frequency response difference between the two speakers and the transmission path. The microphone at the specific position acquires a superposed signal of the signals from the two speakers and the local signal, and the superposed signal has been undergone physical echo cancellation; meanwhile, the sampler acquires the played audio signal and sends the two set of signals to the echo canceller, the echo canceller achieves further echo cancellation through the internal software algorithm and the DT control mechanism, and finally outputs the residual signal as the desired signal which can be used for communication, voice recognition, voiceprint recognition and the like.

More specifically, assuming that the sound signals output by the two speakers are s1 and s2, s1=w1*SL=w1*S, s2=w0*w2*SR=w0*w2*S; Where S is the audio source signal, −1 is the inverter, and w1 is a transducing function of the speaker 301; w2 is a transducing function of the speaker 302; w0 is a transducing function of the corrector, w0 corrects for the difference between w2 and w1 (assuming that transducing functions of echo paths 1 and 2 are exactly equal).

A direct path and a reflecting path reflected by a mold from the two speakers 301 and 302 to the microphone 305 correspond to the echo path 1 (the transducing function h1) and the echo path 2 (h2), respectively, and as seen from the symmetry, h1 is equal to (or approximately equal to) h2.

Therefore, the sum of signals passing through both paths to the microphone is x=h1*s1+h2*s2=(w0*w2*h2-w1*h1)*s. And w0 corrects the difference between w1 and w2. Here, since the two echo paths are close enough, sum (abs ((h1−h2)./h1)) approaches zero, i.e., x approaches zero, thus the sum is far less than w1*h1*s or w0*w2*h2*s. Here, the symbol "I" means a pointwise division, i.e., divisions in each direction of the vector.

In addition to the above two paths, there is a sound signal transmitted back through the room environment. Since the path of the reflected sound signal is much larger than the distance of the direct sound signals, the energy of the direct sound signals received by the microphone is the principal energy.

For example, in a room environment, assuming that the distance between the two paths is 0.1 m, and the distance from the reflection surface of the room to the sound acquisition device is 1 m, the energy of the direct sound signals is 20*log 10 (2*1/0.1)=26 dB higher than that of the reflected sound signal.

As can be seen, the energy of the reflected sound signal is much weaker than the energy of the direct sound signals. The weaker the reflected sound signal may be ignored, or subsequently filtered out by an automatic echo cancellation (AEC) software algorithm.

Finally, the desired signal after echo cancellation is output. The desired signal may be used for communication, speech recognition, voiceprint recognition and the like.

Therefore, by adopting the sound-processing apparatus and the sound-processing method according to the embodiments of the present disclosure, with the symmetrical characteristic of the same amplitude and opposite phase of the sound signal output by at least one pair of the sound transducers, a higher signal-noise ratio can be obtained and a good effect on physical noise reduction is achieved for the original sound signal acquired by the sound acquisition device when compared with the same sound signal output by the single sound transducer. That is, the energy of the first sound signal and the second sound signal respectively output by the first sound transducer and the second sound transducer acquired by the sound acquisition device is less than the energy of the sound signal output by any single sound transducer. Therefore, the sound-processing apparatus according to the embodiments of the present disclosure adopts the sound transducer pairs, utilizing the physical principle of superposition cancellation of waves with opposite phases, and realizes echo cancellation.

Specifically, the embodiments of the present disclosure have the following advantages:

1. for a low volume of sound signal output by a single sound transducer, i.e. a higher original signal-noise ratio, an automatic echo cancellation (AEC) post-processing algorithm may not be needed for the low volume of the sound signal output by the single sound transducer, and the good effect can be obtained only through physical noise reduction, further the physical noise reduction effect is still present when the transfer function is suddenly changed, such as when the output volume is adjusted;
2. the physical noise reduction is not affected by environmental noises;
3. the filtering effect of a low-frequency signal is better due to the fact that the low-frequency wavelength is longer, and the superposition mutual cancellation effect is more remarkable;
4. Due to the existence of physical noise reduction, the signal to noise ratio of the original signal output by a single sound transducer is higher, so that a double-talk detection is better facilitated through correlation of the original signal and the reference signal acquired by the sound acquisition unit;
5. Due to the existence of physical noise reduction, it is ensured that clipping peaks of the sound signal acquired by the sound acquisition device are not distorted for volume of the single sound transducer is too high, when a higher volume is output by the sound transducer.

6、the equidistant placement of four speakers is also effective to stereo echo cancellation. In the case of higher correlation of two channel stereo audio source, the correlation of the stereo signal acquired by the microphone can be cancelled out, so that the filter value of the frequency band with higher correlation is weakened, and the risk that the software algorithm is unstable is weakened.

Exemplary Devices

Figure 5:
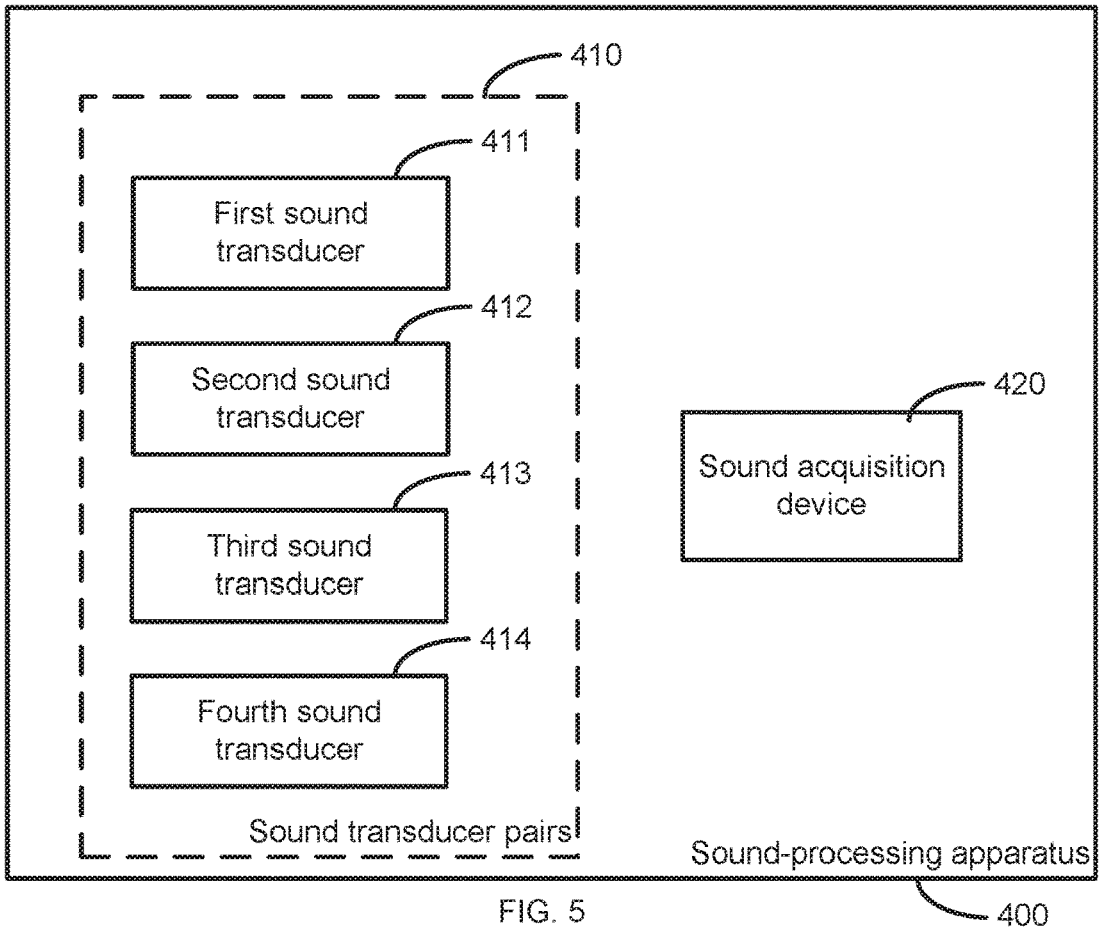
FIG. 5 illustrates a block diagram of a sound-processing apparatus according to another embodiment of the present disclosure.

FIG. 5 illustrates a block diagram of a sound-processing apparatus according to another embodiment of the present disclosure.

In the following, the difference between the embodiment of FIG. 5 and the embodiment of FIG. 1 will be highlighted, primarily in that the sound-processing apparatus comprises at least one set of sound transducers consisting of four sound transducers, instead of at least one pair of sound transducers.

As shown in FIG. 5, a sound-processing apparatus 400 according to an embodiment of the present disclosure comprises at least one set of sound transducers 410, each set of sound transducers comprising a first sound transducer 411 for receiving a left channel signal of stereo source signals and outputting a first sound signal according to the left channel signal; a second sound transducer 412 for receiving a right channel signal of the stereo source signals and outputting a second sound signal according to the right channel signal; a third sound transducer 413 for receiving the left channel signal and outputting a third sound signal according to the left channel signal; and a fourth sound transducer 414 for receiving the right channel signal and outputting a fourth sound signal according to the right channel signal.

In one example, the third sound signal has an opposite phase from the first sound signal and an amplitude whose difference with that of the first sound signal is less than or equal to a first amplitude threshold value, preferably zero; and the fourth sound signal has an opposite phase from the second sound signal and an amplitude whose difference with that of the second sound signal is less than or equal to a second amplitude threshold value, preferably zero.

Further, the first sound signal to the fourth sound signal may have the same amplitude.

The sound-processing apparatus 400 according to an embodiment of the present disclosure also comprises a sound acquisition device 420 for acquiring a sound signal.

In one example, first path-characteristic difference between an amplitude-frequency characteristic of a first sound path from the first sound transducer 411 to the sound acquisition device 420 and an amplitude-frequency characteristic of a third sound path from the third sound transducer 413 to the sound acquisition device 420 is less than or equal to the first characteristic threshold value, preferably zero; and second path-characteristic difference between an amplitude-frequency characteristics of a second sound path from the second sound transducer 412 to the sound acquisition device 420 and an amplitude-frequency characteristic of a fourth sound path from the fourth sound transducer 414 to the sound acquisition device 420 is less than or equal to the second characteristic threshold value, preferably zero.

Further, the first sound path to the fourth sound path may have the same amplitude-frequency characteristic.

In one example, the first sound transducer comprises a first sound output unit for converting the left channel signal into the first sound signal; the second sound transducer comprises a second sound output unit for converting the right channel signal into the second sound signal; the third sound transducer comprises a first inverter for inverting the left channel signal; and a third sound output unit for converting the inverted left channel signal into the third sound signal, first unit-characteristic difference between an amplitude-frequency characteristic of the first sound output unit and an amplitude-frequency characteristic of the third sound output unit is less than or equal to a third characteristic threshold value, preferably zero; and the fourth sound transducer comprises a second inverter for inverting the right channel signal; and a fourth sound output unit for converting the inverted right channel signal to the fourth sound signal, second unit-characteristic difference between an amplitude-frequency characteristic of the second sound output unit and an amplitude-frequency characteristic of the fourth sound output unit is less than or equal to a fourth characteristic threshold value, preferably zero.

Further, the first sound output unit to the fourth sound output unit may have the same amplitude-frequency characteristic.

In one example, one or both of the first sound transducer 411 and the third sound transducer 413 may include a corrector for compensating the left channel signal or the inverted left channel signal according to at least one of the first path-characteristic difference and the first unit-characteristic difference. And one or both of the second sound transducer 412 and the fourth sound transducer 414 may include a corrector for compensating the right channel signal or the inverted right channel signal according to at least one of the second path-characteristic difference and the second unit-characteristic difference.

Further, the two or more correctors described above may also be used to comprehensively cancel out the difference in amplitude of the first sound signal to the fourth sound signal.

In one example, distance difference between the first sound path and the third sound path is less than or equal to a first distance threshold value, preferably zero; and distance difference between the second sound path and the fourth sound path is less than or equal to a second distance threshold value, preferably zero.

Further, the first sound path to the fourth sound path have the same distance.

In one example, the first sound output unit, the second sound output unit, the third sound output unit, and the fourth sound output unit are arranged symmetrically with respect to a body of the sound acquisition device.

As described above, in the case of the shell being a regular tetrahedron, the four sound output units may be disposed at the four vertex positions of the regular tetrahedron, respectively, and the sound acquisition device may be disposed at the body center position. Here, the position where the sound acquisition device is located is the only one position that is equidistant from the four sound output units. Therefore, the four sound output units can be divided into two sets, the first sound output unit playing a signal on the left stereo channel, a second sound output unit playing a signal on the right stereo channel, and a third sound output unit playing an inverted left channel signal and a fourth sound output unit playing an inverted right channel signal. Thus, in the case of stereo signals, a physical superposition cancellation of echoes is achieved, thereby a stereo scenario of automatic echo cancellation (AEC) is achieved.

Exemplary Methods

Figure 6:
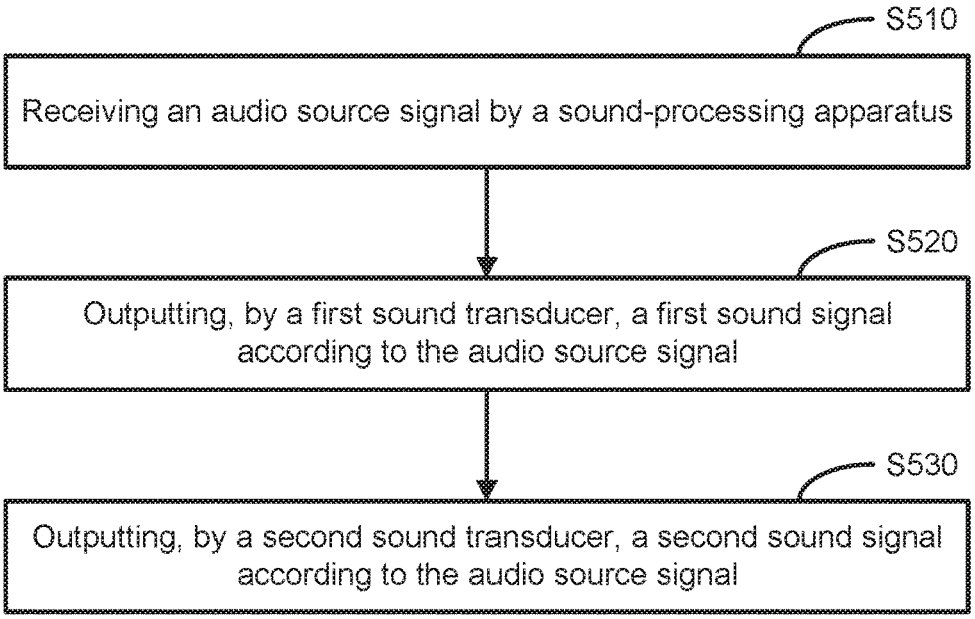
FIG. 6 illustrates a flowchart of a sound-processing method according to an embodiment of the present disclosure.

FIG. 6 illustrates a flowchart of a sound-processing method according to an embodiment of the present disclosure.

As shown in FIG. 6, a sound-processing method according to an embodiment of the present disclosure comprises:

In step S510, receiving an audio source signal by a sound-processing apparatus, the sound-processing device comprising at least one pair of sound transducers and a sound acquisition device, each pair of sound transducers including a first sound transducer and a second sound transducer;

In step S520, outputting, by the first sound transducer, a first sound signal according to the audio source signal; and In step S530, outputting, by the second sound transducer, a second sound signal according to the audio source signal, the second sound signal having an opposite phase from the first sound signal, and difference between an amplitude of the second sound signal and an amplitude of the first sound signal being less than or equal to an amplitude threshold value.

The sound-processing method described above further comprises: acquiring a sound signal by the sound acquisition device; sampling the audio source signal to obtain a reference signal; and performing noise reduction processing on the sound signal acquired by the sound acquisition device based on the reference signal.

For example, a residual component of the audio source signal may be cancelled from a sound signal acquired by the sound acquisition device based on the reference signal by at least one of an adaptive filtering algorithm and a double-talk control mechanism.

It should be understood by those skilled in the art that other details of the Sound-processing method according to embodiments of the present disclosure are identical to the corresponding details previously described with respect to the sound-processing apparatus according to embodiments of the present disclosure and are not repeated in detail in order to avoid redundancy.

The above description in combination with embodiments describes the basic principle of the present disclosure, however, it should be noted that the advantages, preponderances, effects etc. are only examples, not limitation, and these advantages, preponderances, effects etc. should not be considered necessary for every embodiment of the present disclosure. Furthermore, the specific details of the above disclosure are only for the purpose of illustration and the understanding of the present disclosure, and are not intended to limit the present disclosure.

The block diagram of the apparatus, device, equipment, and system mentioned in the present disclosure are only exemplary examples, and are not intended to require or suggest connecting, arranging and configuring in the way showed. As known by the those skilled in the art, these apparatus, device, equipment, and system can be connected, arranged, and configured by any way. The open wordings such as "comprise", "include" and "have" etc. are to be construed and can be interchanged with "including but not limited to". The wordings "and" and "or" here are to be construed and can ba interchanged with "and/or", unless otherwise indicated clearly in the context. The wordings "such as" and "for example" are to be construed and can be interchange with "such as but not limited to".

It should be noted that in the apparatus, device and method of the present disclosure, the various components or steps may be disassembled and/or recombined. Such disassemblage and recombination should be considered as equivalent of the present disclosure.

The previous description of the disclosed aspects is provided to enable any person skilled in the art to make or use the present disclosure. Various modifications to these aspects will be readily apparent to those skilled in the art, and the generic principles defined herein may be applied to other aspects without departing from the scope of the present disclosure. Therefore, the present disclosure is not intended to be limited to the aspects shown herein but is to be accorded the widest scope consistent with the principles and novel features disclosed herein.

The above description has been provided for the purposes of illustration and description. In addition, this description is not intended to limit the embodiments of the present disclosure to the forms disclosed herein. Although various example aspects and embodiments have been discussed above, those skilled in the art will recognize certain variations, modifications, alterations, additions and sub-combinations thereof.

What is claimed is:

1. A sound-processing apparatus comprising:

at least one pair of sound transducers, each pair of sound transducers including a. a first sound transducer for receiving an audio source signal and outputting a first sound signal according to the audio source signal; and b. a second sound transducer for receiving the audio source signal and outputting a second sound signal according to the audio source signal, c. the second sound signal having an opposite phase from the first sound signal, and difference between an amplitude of the second sound signal and an amplitude of the first sound signal being less than or equal to an amplitude threshold value; and a sound acquisition device for acquiring a sound signal, path-characteristic difference between an amplitude-frequency characteristic of a first sound path from the first sound transducer to the sound acquisition device and an amplitude-frequency characteristic of a second sound path from the second sound transducer to the sound acquisition device being less than or equal to a first characteristic threshold value.

2. The sound-processing apparatus of claim 1, wherein, the first sound transducer comprises a first sound output unit for converting the audio source signal into the first sound signal; and the second sound transducer comprises an inverter for inverting the audio source signal and a second sound output unit for converting the inverted audio source signal to the second sound signal, unit-characteristic difference between an amplitude-frequency characteristic of the first sound output unit and an amplitude-frequency characteristic of the second sound output unit is less than or equal to a second characteristic threshold value.

3. The sound-processing apparatus of claim 2, wherein the first sound transducer further comprises a corrector for compensating the audio source signal according to at least one of the path-characteristic difference and the unit-characteristic difference before the audio source signal reaches the first sound output unit.

4. The sound-processing apparatus of claim 2, wherein the second sound transducer further comprises a corrector for compensating the audio source signal or the inverted audio source signal according to at least one of the path-characteristic difference and the unit-characteristic difference before the audio source signal reaches the inverter or before the inverted audio source signal reaches the second sound output unit.

5. The sound-processing apparatus of claim 2, wherein distance difference between the first sound path and the second sound path is less than or equal to a distance threshold value.

6. The Sound-processing apparatus of claim 5, wherein the first sound output unit and the second sound output unit are plane-symmetrically positioned relative to the sound acquisition device.

7. The sound-processing apparatus of claim 6, further comprising:

a shell having a first position, and a second position and a third position that are symmetrical with respect to the first position, the sound acquisition device being arranged at the first position, the first sound output unit and the second sound output unit being arranged at the second position and the third position, respectively, and having the same distance and orientation angle relative to the sound acquisition device.

8. The sound-processing apparatus of claim 7, wherein the shell has consistent material at its symmetrical position with respect to the sound acquisition device.

9. The sound-processing apparatus of claim 7, wherein the shell is a cylinder, the sound acquisition device being disposed at a center position in a bottom surface of the cylinder, the first sound output unit and the second sound output unit being disposed at positions in a circumferential surface of the cylinder symmetrical relative to an axis of the cylinder.

10. The sound-processing apparatus of claim 7, wherein the shell is a cuboid, the sound acquisition device being disposed at a center position in a bottom surface of the cuboid, the first sound output unit and the second sound output unit being disposed at positions in two opposite sides of the cuboid symmetrical relative to a volume centerline of the cuboid.

11. The sound-processing apparatus of claim 1, further comprising:

a sampler for sampling the audio source signal to obtain a reference signal; and an echo canceller for performing noise reduction processing on the sound signal acquired by the sound acquisition device based on the reference signal.

12. The sound-processing apparatus of claim 11, wherein the echo canceller removes residual component of the audio source signal from the sound signal acquired by the sound acquisition device based on the reference signal through at least one of an adaptive filtering algorithm and a double-talk control mechanism.

13. A sound-processing apparatus comprising:

at least one set of sound transducers, each set of sound transducers comprising:

d. a first sound transducer for receiving a left channel signal of stereo source signals and outputting a first sound signal according to the left channel signal;

e. a second sound transducer for receiving a right channel signal of the stereo source signals and outputting a second sound signal according to the right channel signal;

f. a third sound transducer for receiving the left channel signal and outputting a third sound signal according to the left channel signal; and g. a fourth sound transducer for receiving the right channel signal and outputting a fourth sound signal according to the right channel signal, h. the third sound signal having a phase opposite to that of the first sound signal and difference between an amplitude of the third sound signal and an amplitude of the first sound signal being less than or equal to a first amplitude threshold value, and the fourth sound signal having a phase opposite to that of the first sound signal and difference between an amplitude of the fourth sound signal and an amplitude of the second sound signal being less than or equal to a second amplitude threshold value; and a sound acquisition device for acquiring a sound signal, first path-characteristic difference between an amplitude-frequency characteristic of a first sound path from the first sound transducer to the sound acquisition device and an amplitude-frequency characteristic of a third sound path from the third sound transducer to the sound acquisition device being less than or equal to a frist characteristic threshold value, and second path-characteristic difference between an amplitude-frequency characteristic of a second sound path from the second sound transducer to the sound acquisition device and an amplitude-frequency characteristic of a fourth sound path from the fourth sound transducer to the sound acquisition device being less than or equal to a second characteristic threshold value.

14. A sound-processing method comprising:

receiving an audio source signal by a sound-processing apparatus, the sound-processing device comprising at least one pair of sound transducers and a sound acquisition device, each pair of sound transducers comprising a first sound transducer and a second sound transducer;

outputting, by the first sound transducer, a first sound signal according to the audio source signal; and outputting, by the second sound transducer, a second sound signal according to the audio source signal, the second sound signal having a phase opposite to that of the first sound signal, and difference between an amplitude of the second sound signal and an amplitude of the first sound signal being less than or equal to an amplitude threshold value.

15. The sound-processing method of claim 14, further comprising:

acquiring a sound signal by the sound acquisition device;

sampling the audio source signal to obtain a reference signal; and performing noise reduction processing on the sound signal acquired by the sound acquisition device based on the reference signal.

* * * * *